US009143866B2

(12) United States Patent
Trainer

(10) Patent No.: US 9,143,866 B2
(45) Date of Patent: Sep. 22, 2015

(54) VOICE COIL FORMER STIFFENER

(75) Inventor: Mark Trainer, Northridge, CA (US)

(73) Assignee: Strata Audio LLC, Westlake Village, CA (US)

( * ) Notice: Subject to any disclaimer, the term of this patent is extended or adjusted under 35 U.S.C. 154(b) by 0 days.

(21) Appl. No.: 13/547,679

(22) Filed: Jul. 12, 2012

(65) Prior Publication Data

US 2013/0016872 A1 Jan. 17, 2013

Related U.S. Application Data

(60) Provisional application No. 61/506,910, filed on Jul. 12, 2011.

(51) Int. Cl.

| | |
|---|---|
| ***H04R 9/06*** | (2006.01) |
| ***H04R 9/04*** | (2006.01) |
| ***H04R 7/20*** | (2006.01) |
| ***H04R 7/16*** | (2006.01) |

(52) U.S. Cl.

CPC ..... *H04R 9/045* (2013.01); *H04R 7/16* (2013.01); *H04R 7/20* (2013.01); *H04R 9/043* (2013.01); *H04R 2231/003* (2013.01)

(58) Field of Classification Search

CPC ..... H04R 9/04; H04R 9/041; H04R 9/045; H04R 9/046; H04R 9/06; H04R 7/16; H04R 7/20; H04R 7/24; H04R 9/043; H04R 7/02; H04R 31/006; H04R 2231/003

USPC ..... 381/342, 182, 186, 398, 401, 402, 403, 381/404, 405, 407, 430; 181/144, 165, 171, 181/172

See application file for complete search history.

(56) References Cited

U.S. PATENT DOCUMENTS

| | | | | |
|---|---|---|---|---|
| 2,084,945 | A * | 6/1937 | Cornwell | 381/407 |
| 2,164,374 | A * | 7/1939 | Barker | 381/405 |
| 2,235,654 | A * | 3/1941 | Steers | 381/403 |
| 2,269,284 | A * | 1/1942 | Olson | 381/342 |
| 4,017,694 | A | 4/1977 | King | |
| 4,163,876 | A | 8/1979 | Ohnuki | |
| 4,472,604 | A | 9/1984 | Nakamura | |
| 5,335,287 | A | 8/1994 | Athanas | |
| 5,517,573 | A | 5/1996 | Polk et al. | |
| 5,664,024 | A * | 9/1997 | Furuta et al. | 381/412 |
| 5,701,358 | A | 12/1997 | Larsen et al. | |
| 5,757,946 | A | 5/1998 | Van Schyndel | |
| 5,802,193 | A | 9/1998 | Kieltyka | |
| 5,848,173 | A | 12/1998 | Sato et al. | |
| 5,892,183 | A | 4/1999 | Roozen et al. | |
| 6,343,136 | B2 * | 1/2002 | Tokusho et al. | 381/398 |
| 6,621,912 | B2 * | 9/2003 | Sugiyama et al. | 381/407 |
| 6,694,037 | B1 | 2/2004 | Robinson et al. | |

(Continued)

FOREIGN PATENT DOCUMENTS

| | | | |
|---|---|---|---|
| DE | 2604888 | A1 | 8/1976 |
| DE | 20116576 | U1 | 1/2002 |
| WO | 2010/097568 | | 9/2010 |

*Primary Examiner* — Huyen D Le

(74) *Attorney, Agent, or Firm* — Fish & Tsang LLP

(57) ABSTRACT

A support member for a voice coil former in an audio transducer is described. The support member comprises a bridge between the inner surface of the voice coil former and a radiating surface, such as a diaphragm or cone, which is disposed in the center of the voice coil former. The support member provides added rigidity to reduce wobble during operation of the transducer.

10 Claims, 3 Drawing Sheets

(56) References Cited

U.S. PATENT DOCUMENTS

| | | | |
|---|---|---|---|
| 6,944,310 | B2 | 9/2005 | Ito et al. |
| 6,968,069 | B1 | 11/2005 | Zhao |
| 7,177,440 | B2 | 2/2007 | Turnmire et al. |
| 7,515,728 | B2 | 4/2009 | Kobayashi et al. |
| 7,711,134 | B2 | 5/2010 | Stead et al. |
| 7,729,504 | B2 | 6/2010 | Tsuda et al. |
| 7,835,536 | B2 | 11/2010 | Inagaki et al. |
| 2002/0176596 | A1 | 11/2002 | Fujinami et al. |
| 2003/0121718 | A1 | 7/2003 | Stead et al. |
| 2004/0005074 | A1 | 1/2004 | George |
| 2004/0188175 | A1 | 9/2004 | Sahyoun |
| 2005/0152577 | A1 | 7/2005 | Nishimura et al. |
| 2005/0185816 | A1 | 8/2005 | Roark et al. |
| 2005/0185817 | A1 | 8/2005 | Stead et al. |
| 2007/0160257 | A1 | 7/2007 | Stiles |
| 2007/0189572 | A1 | 8/2007 | Juall |
| 2008/0232633 | A1 | 9/2008 | Corynen |
| 2008/0317276 | A1 | 12/2008 | Sorensen et al. |
| 2009/0208048 | A1 | 8/2009 | Haas |
| 2009/0214075 | A1 | 8/2009 | Inoue et al. |
| 2009/0262960 | A1 | 10/2009 | Kim |
| 2010/0303278 | A1 | 12/2010 | Sahyoun |
| 2011/0299718 | A1 | 12/2011 | Williamson |

* cited by examiner

FIG. 1
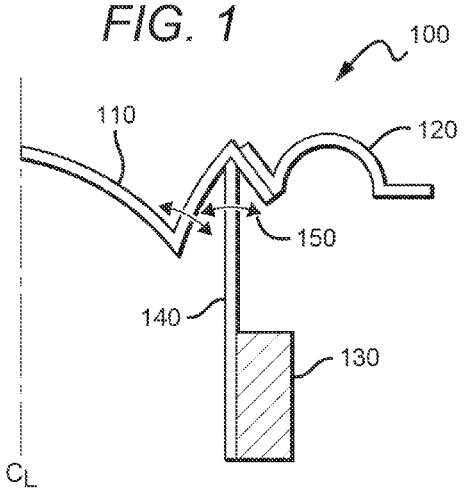
FIG. 3
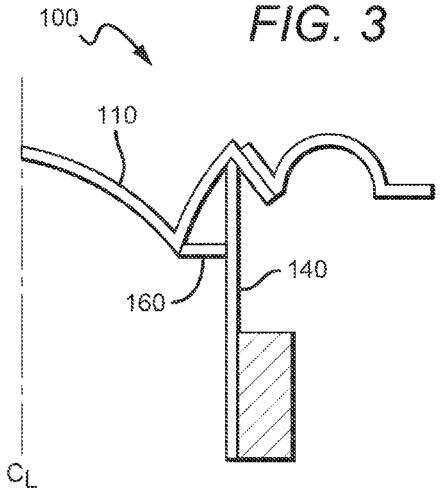
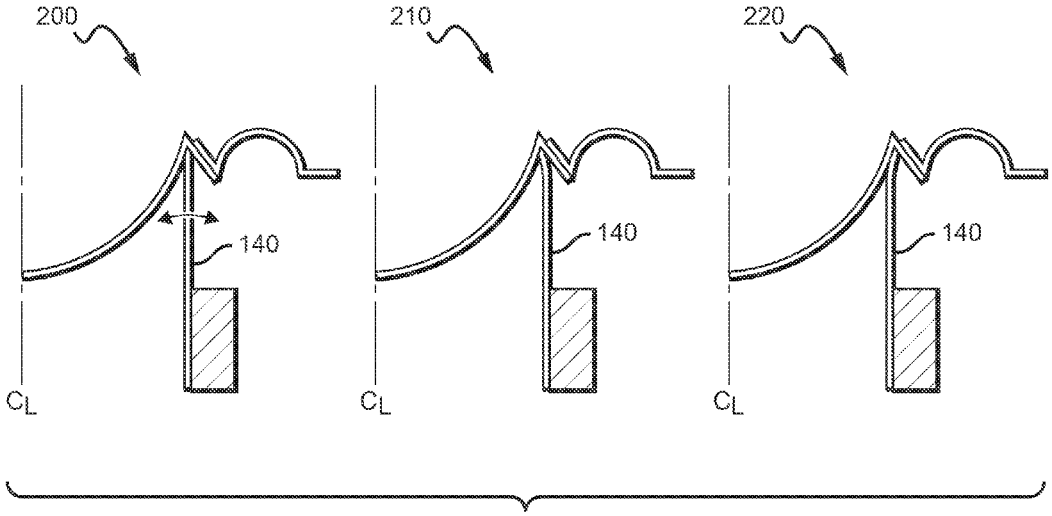
FIG. 2

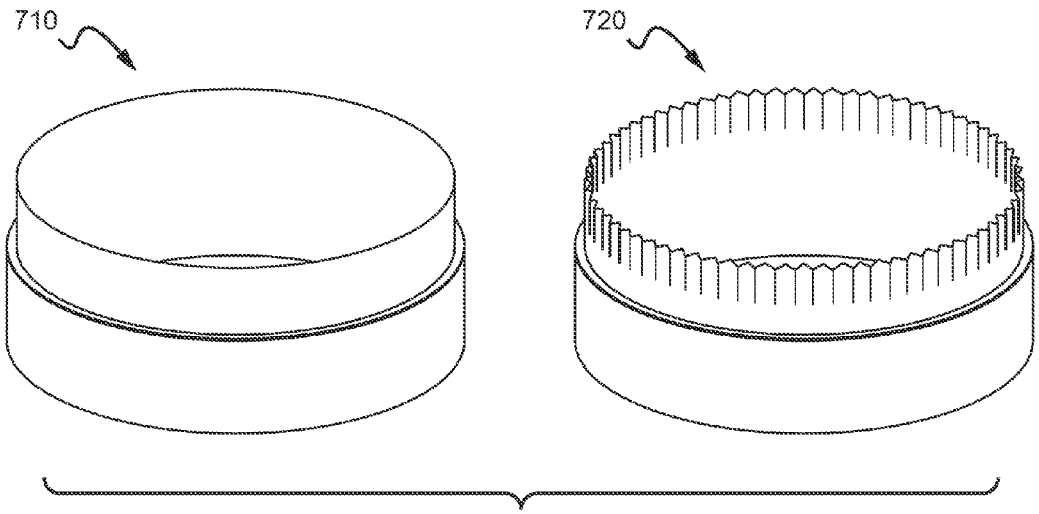
FIG. 7
FIG. 8
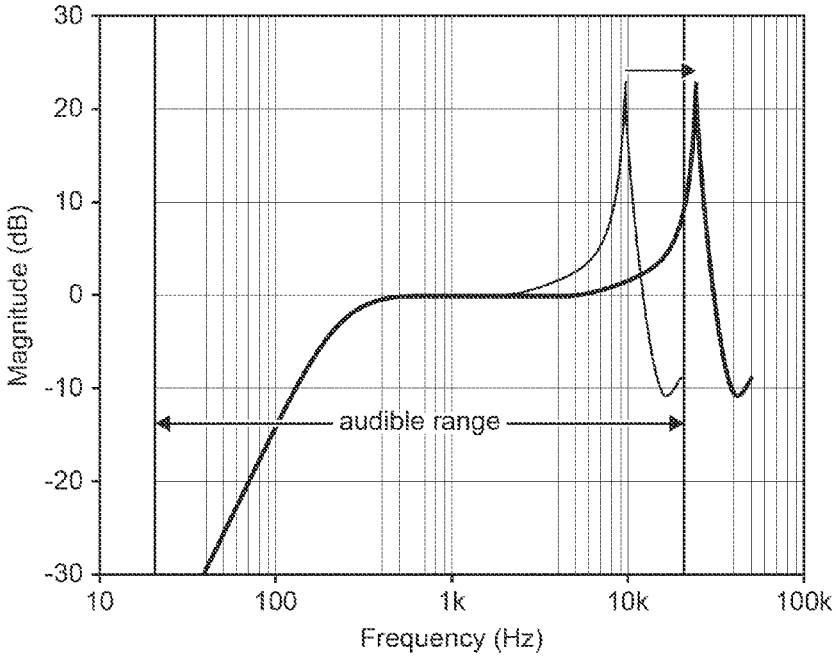

VOICE COIL FORMER STIFFENER

This application claims the benefit of priority to provisional application Ser. No. 61/506910 filed on Jul. 12, 2011, which is incorporated herein by reference.

FIELD OF THE INVENTION

The field of the invention is audio transducers.

BACKGROUND

The background description includes information that may be useful in understanding the present inventive subject matter. It is not an admission that any of the information provided herein is prior art or relevant to the presently claimed inventive subject matter, or that any publication specifically or implicitly referenced is prior art.

Transducers (i.e., audio loudspeakers) are well known and generally comprise a radiating surface (e.g., dome, diaphragm, membrane, cone, etc) attached to a voice coil former (also referred to as a bobbin). The voice coil former is attached to a voice coil, which is suspended in a static magnetic field. An amplifier is electrically coupled to the voice coil and provides a current (i.e., signal) to the voice coil. The current produces an electromagnetic field around the coil, which interacts with the static magnetic field and causes the coil to vibrate up and down. The coil, in turn, causes the radiating surface to vibrate, which vibrates the surrounding air to produce audio waves.

One of the problems with transducers is the tendency of the voice coil former to flex and bend as it vibrates up and down. Bending of the voice coil former allows the radiating surface to "wobble" in a sideways motion, which can produce unwanted resonance and sub-optimal sound quality.

US20090214075 to Inoue discloses a loudspeaker having a vibration system comprising (i) a dome diaphragm, (ii) a cone diaphragm, and (iii) a voice coil bobbin. Inoue improves the rigidity of the vibration system by providing a high-strength adhesive bond between the dome diaphragm and the voice coil bobbin.

All materials and references cited herein are incorporated by reference to the same extent as if each individual reference were specifically and individually indicated to be incorporated by reference. Where a definition or use of a term in an incorporated reference is inconsistent or contrary to the definition of that term provided herein, the definition of that term provided herein applies and the definition of that term in the reference does not apply.

US20100303278 to Sahyoun discloses a low profile speaker that reduces wobble of the voice coil former by using a cone diaphragm that attaches to the former at a point slightly below the top of the former.

Inoue, Sahyoun, and all other known prior art references fail to contemplate that a voice coil former can be reinforced and stiffened by corrugating the top circumferential surface of the former. Furthermore, these references fail to appreciate that a voice coil former can be reinforced and stiffened from the interior side of the former.

Thus, there is still a need for voice coil formers with improved stiffness.

SUMMARY OF THE INVENTION

The inventive subject matter provides apparatus, systems, and methods in which a support member for a voice coil former in an audio transducer comprises an elongated portion having a first end and a second end. The first end is configured to couple to an inner surface of the coil former. The elongated portion extends from the inner surface towards a center of the voice coil former. The second end is configured to couple to a radiating surface (e.g., diaphragm, dome, membrane, cone, etc.) that is disposed in the center of the voice coil former.

In one aspect of some embodiments, the first end can be a flange. Additionally, the second end can be integral with the radiating surface, affixed to the radiating surface, or integral with a radiating surface outer edge that is, in turn, affixed to a surround suspension.

In other aspects of some embodiments, the elongated portion can be a ring configured to couple with the inner surface of the voice coil former. In other embodiments, the elongated portion forms a ribbed ring around the inner surface of the voice coil former.

In another aspect of the inventive subject matter, a voice coil former has a corrugated circumferential surface for providing improved rigidity. The corrugated circumferential surface can be circular, oval, or even irregular-shaped.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DESCRIPTION

FIG. 1 shows a cross sectional view of a transducer.

FIG. 2 shows three cross sectional views of the transducer in FIG. 1 as it experiences wobble.

FIG. 3 shows a cross sectional view of a transducer that has a supporting bridge.

FIG. 7 shows a perspective view of a non-corrugated voice coil former and a corrugated voice coil former.

FIG. 8 is a graph that demonstrates how a supporting bridge can reduce unwanted noise.

DETAILED DESCRIPTION

Figure 4:
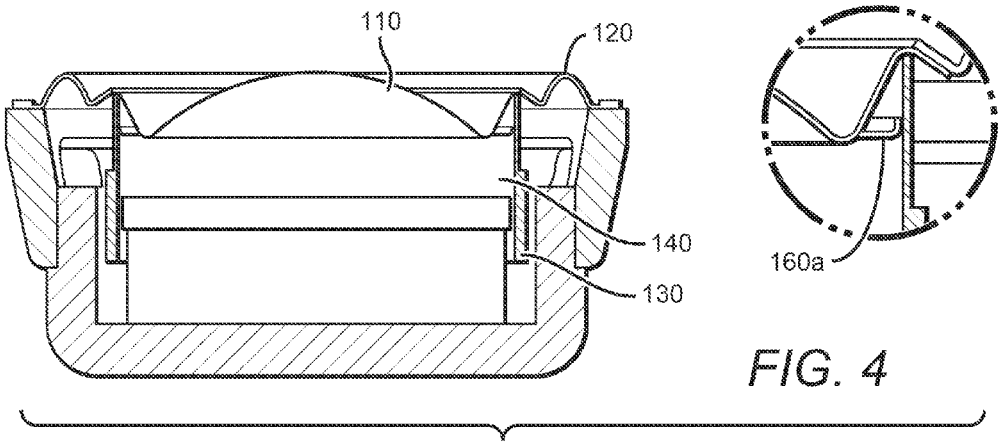
FIG. 4 shows a cross sectional view of a transducer that has a supporting bridge.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

One should appreciate that the disclosed devices and techniques provide many advantageous technical effects, including improved sound quality for audio transducers.

FIG. 1 shows a cross-sectional view of the vibration components of a transducer 100. The vibration components are: W-shape radiating surface 110, surround/suspension 120, voice coil 130, and voice coil former 140. Wobble arrows 150 show how voice coil former 140 can bend during operation of transducer 100, resulting in unwanted resonance and poor sound quality.

FIG. 2 shows three views of transducer 100 as it vibrates. In view 210 voice coil former 140 is bent to the left. In view 220 voice coil former 140 is bent to the right.

FIG. 3 shows transducer 100 with a supporting bridge 160. Bridge 160 has a first end affixed to voice coil former 140 and a second end affixed to radiating surface 110. Bridge 160 reinforces voice coil former 140 and radiating surface 110, and provides sufficient rigidity to prevent unwanted resonance within the audible range.

Figure 5:
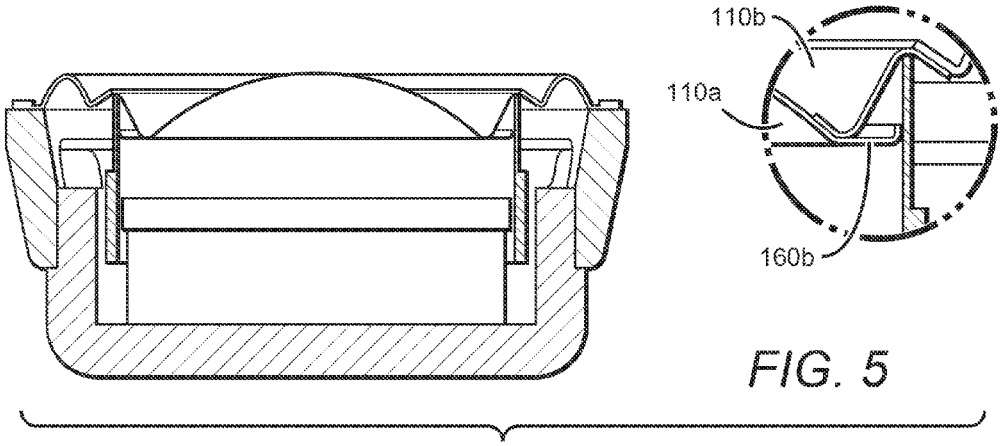
FIG. 5 shows a cross sectional view of a transducer that has a supporting bridge.
Figure 6:
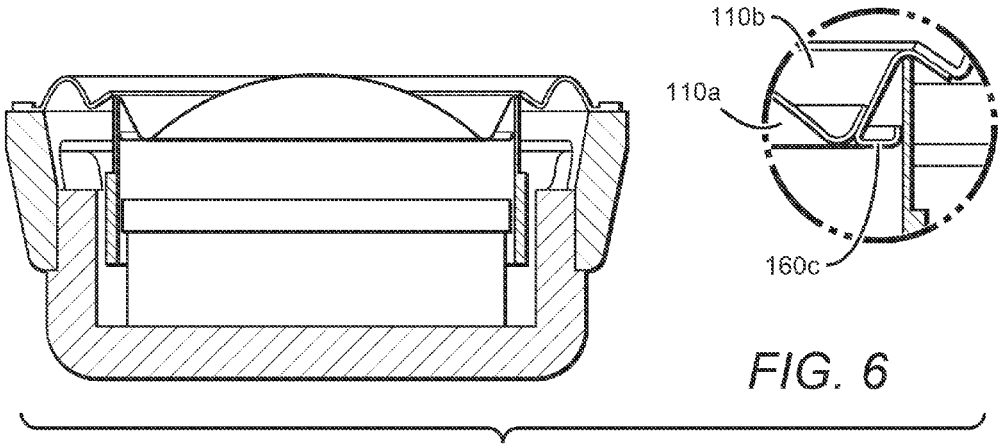
FIG. 6 shows a cross sectional view of a transducer that has a supporting bridge.

FIGS. 4-6 show perspective views of three different variations of a bridge 160. In FIG. 4, bridge 160*a* is a separate component from radiating surface 110 and is affixed to radiating surface 110 and voice coil former 140 with an adhesive. From a perspective view, bridge 160*a* comprises a ring structure. In FIG. 5, bridge 160*b* is one integral component with the center portion 110*a* of radiating surface 110. In this embodiment, bridge 160*b* is an extension of center portion 110*a*. The "second end" of bridge 160*b* is the portion of bridge 160*b* that meets with the outer portion 110*b* of radiating surface 110. In FIG. 6, bridge 160*c* is one integral component with outer portion 110*b*. From a perspective view, bridge 160*c* comprises a ring structure that overlaps the top of voice coil former 140 to couple with surround/suspension 120. The "second end" of bridge 160*c* is the portion of bridge 160*c* that meets with center portion 110*a*. Bridges 160*a*-160*c* all have a first end configured as a lip (e.g, flange) that is affixed to the inner circumferential surface of voice coil former 140. The circumferential surface can be oval, circular, or even irregular shaped. However, the first end of bridge 160*c* differs from the first end of bridge 160*a* and bridge 160*b* in that it has a spoke/rib structure that couples with the inner circumferential surface of voice coil former 140 at radial intervals.

FIG. 7 shows a perspective view of a voice coil former 710 and 720. Former 710 is a traditional voice coil former. Former 720 shows an improved voice coil former that has a corrugated circumferential surface. The corrugated circumferential surface resembles a cupcake paper liner. The corrugated shape of former 720 provides sufficient rigidity such that unwanted resonance is eliminated from the audible range. The corrugated shape of former 720 may also provide sufficient rigidity such that no additional supporting member (e.g., support 160) is needed.

FIG. 8 is a graph that demonstrates the desirable results of providing improved rigidity and stiffness to a voice coil former. The inventive subject matter disclosed herein provides sufficient stiffness to the voice coil former such that the unwanted resonance (i.e., spike in the graph) is shifted out of the audible range.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the inventive subject matter and does not pose a limitation on the scope of the inventive subject matter otherwise claimed. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A support member for an audio transducer having a voice coil former affixed to a radiating surface, comprising:

an elongated portion having a first end and a second end;

wherein the first end comprises a flange that is directly affixed to an inner surface of the voice coil former, the elongated portion extends from the inner surface and substantially orthogonally towards a center of the voice coil former, and the second end is directly affixed to a portion of a radiating surface that is disposed in the center of the voice coil former; and wherein the elongated portion has sufficient rigidity to reduce unwanted resonance within the audible range from the voice coil former when directly affixed to the inner surface of the voice coil former and to the radiating surface.

2. The support member of claim 1, wherein the second end is integral with the radiating surface.

3. The support member of claim 1, wherein the second end is integral with an outer edge of the radiating surface and is affixed to a surround suspension.

4. The support member of claim 1, wherein the elongated portion comprises a ring configured to directly affix to the inner surface of the voice coil former.

5. The support member of claim 1, wherein the elongated portion forms a ribbed ring around the inner surface of the voice coil former.

6. A transducer assembly, comprising:

a radiating surface at least partially disposed in a center of a voice coil former, wherein the voice coil former has an upper perimeter, a lower perimeter, an outer surface and an inner surface;

a ring-shaped support member comprising a width defining a first edge and a second edge;

wherein the first edge comprises a flange that is directly affixed to the inner surface of the voice coil former, the width of the support member extends inward from the inner surface of the voice coil former towards the center of the voice coil former, and the second edge is directly affixed to an outer surface of the radiating surface disposed at the center of the voice coil former between a height of the upper perimeter and a height of the lower perimeter; and wherein the support member has sufficient rigidity to reduce unwanted resonance within the audible range from the voice coil former when directly affixed to the inner surface of the voice coil former and to the radiating surface.

7. The transducer assembly of claim 6, wherein the voice coil former is cylindrical.

8. The transducer assembly of claim 6, wherein the width of the support member extends inward from the inner surface entirely in a non-parallel orientation relative to the voice coilformer.

9. The transducer assembly of claim 6, wherein the width of the support member forms a ribbed ring around the inner surface of the voice coil former.

10. A support member for an audio transducer having a voice coil former affixed to a radiating surface, comprising:

an elongated portion having a first end and a second end;

wherein the first end comprises a flange that aligns with an inner surface of the voice coil former, the elongated portion extends towards a center of the voice coil former, and the second end is affixed to a surround suspension and is integral with an outer edge of a radiating surface disposed in the center of the voice coil former; and wherein the elongated portion has sufficient rigidity to reduce unwanted resonance within the audible range from the voice coil former when aligned with the inner surface of the voice coil former and affixed to the surround suspension.

* * * * *